US005768873A

United States Patent [19]

Stiller

[11] Patent Number: 5,768,873

[45] Date of Patent: Jun. 23, 1998

[54] METHOD AND DEVICE FOR TESTING A PNEUMATIC SPLICING VALVE

[75] Inventor: Joachim Stiller, Wegberg, Germany

[73] Assignee: W. Schlafhorst AG & Co., Moenchengladbach, Germany

[21] Appl. No.: 710,377

[22] Filed: Sep. 16, 1996

[30] Foreign Application Priority Data

Sep. 14, 1995 [DE] Germany ..... 195 34 114.7

[51] Int. Cl.[6] ..... D01H 17/00

[52] U.S. Cl. ..... 57/22; 57/264; 57/350

[58] Field of Search ..... 57/264, 22, 350; 73/118.2, 201, 865.9, 714

[56] References Cited

U.S. PATENT DOCUMENTS

| | | | |
|---|---|---|---|
| 4,232,509 | 11/1980 | Rohner et al. | 57/22 |
| 4,344,277 | 8/1982 | Rohner et al. | 57/22 |
| 4,397,139 | 8/1983 | Wey et al. | 57/22 |
| 4,408,442 | 10/1983 | Rohner | 57/22 |
| 4,438,621 | 3/1984 | Rohner | 57/22 |
| 4,573,313 | 3/1986 | Bertrams | 57/22 |
| 4,577,458 | 3/1986 | Garnsworthy | 57/22 |
| 4,653,258 | 3/1987 | Rohner | 57/22 |
| 5,182,900 | 2/1993 | Horak et al. | 57/22 |

FOREIGN PATENT DOCUMENTS

| | | |
|---|---|---|
| 30 33 050 A1 | 4/1982 | Germany . |
| 33 23 890 A1 | 1/1985 | Germany . |
| 39 42 864 A1 | 6/1991 | Germany . |
| 43 14 982 A1 | 11/1994 | Germany . |

*Primary Examiner*—William Stryjewski
*Attorney, Agent, or Firm*—Kennedy Covington Lobdell & Hickman, LLP

[57] ABSTRACT

A method used in conjunction with a yarn splicing device having a pneumatic splicing chamber, a compressed air line connecting the splicing chamber to a source of compressed air, an electromagnetic splicing valve disposed within the compressed air line and having two transitional positions (open and closed) for controlling delivery of the compressed air to the splicing chamber, and a control unit connected to the valve for initiating a transitional signal to the valve for opening and closing of the valve, the method including, after initiating the transitional signal to the valve, the steps of determining a value representing a characteristic of the changing air pressure prevailing in the compressed air line resulting from a transition of the valve from the open position to the closed position, comparing the determined value with a reference value, and generating an error signal if the difference between the determined value and the reference value is greater than a predetermined variance value. Preferably, the air pressure prevailing in the line is determined after a predetermined length of time following initiation of a transitional signal, and the generating of the error signal preferably includes the activation of an optical and an audible alarm. The reference value is preferably either operator-entered or calculated from other determined values from other similar splicing devices. The present invention also includes a device operating in accordance with the described method.

14 Claims, 2 Drawing Sheets

Fig. 2
Fig. 2a
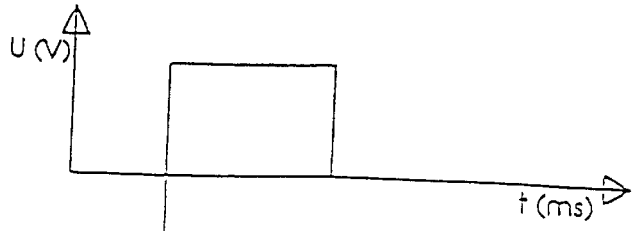
Fig. 2b
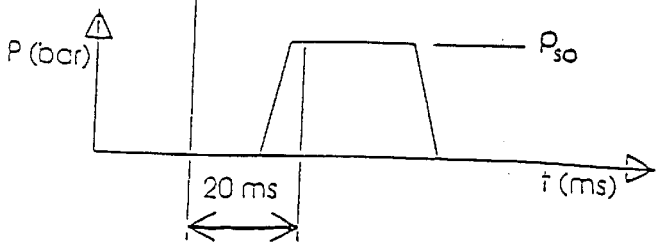
Fig. 3
Fig. 3a
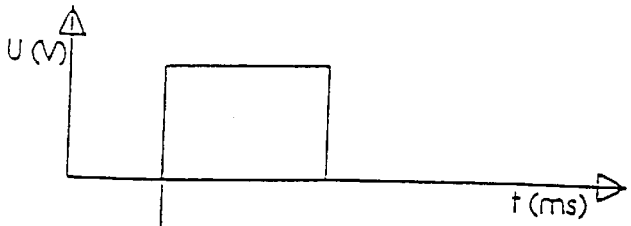
Fig. 3b
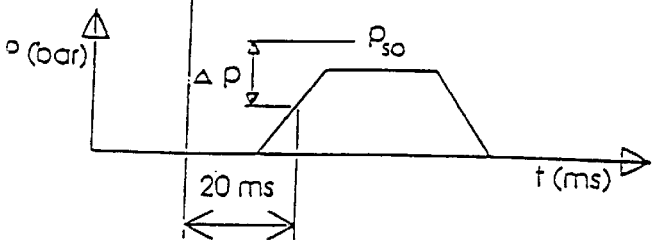
Fig. 4
Fig. 4a
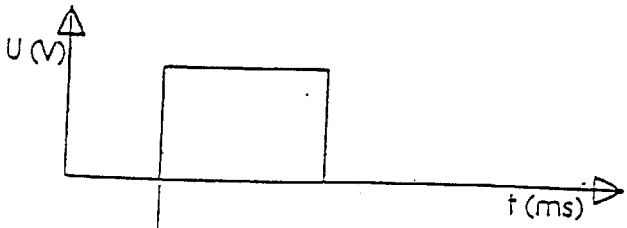
Fig. 4b
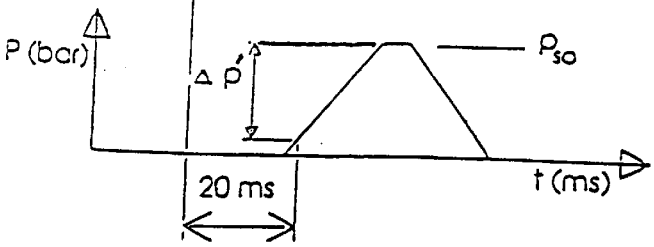

METHOD AND DEVICE FOR TESTING A PNEUMATIC SPLICING VALVE

FIELD OF THE INVENTION

The invention generally relates to pneumatic yarn splicing devices and, particularly, to a method and a device for testing a pneumatic splicing valve used in a pneumatic yarn splicing device.

BACKGROUND OF THE INVENTION

Pneumatic yarn splicing devices are commonly used in the textile industry in automatic winding machines for the production of cheeses or yarn packages from spinning bobbins without yarn defects and, in particular, without yarn knots. Moreover, it is possible to achieve spliced connections with pneumatic splicing devices that very closely approximate the quality, strength, and appearance of the unspliced portions of the yarn.

The quality, strength, and the appearance of the spliced connection all are dependent upon certain conditions that in turn vary depending upon the yarn to be spliced, namely, the time of the opening of the yarn ends that are to be spliced together, the pressure of the compressed air applied in the splicing operation, the duration the compressed air is applied, and the shape of the splicing chamber, among other things.

It is known from DE 30 33 050 C2 to monitor the pressure of the compressed air in the compressed air source that is to be delivered to the winding machine and to stop the splicing operation when the monitored pressure falls below a minimum pressure and/or to trigger an alarm device.

It is also known from DE 39 42 864 A1 to test the operation of a splicing device of a machine by means of a testing device which can be applied to each individual splicing device. This testing device contains a measuring tube which is attached to a splicing chamber of a splicing device and contains sensors connected to an evaluating computer for detecting whether the predetermined quality pressure, flow speed, and temperature are reached within the splicing chamber. A comparison by the evaluating computer is made between optimum reference values and the measured values obtained from the sensors. A drawback to this device and testing method, however, is that it is very time-intensive and cost-intensive and also requires the partial stopping of the winding machine. In addition, testing of the individual splicing devices is only periodically possible.

It is furthermore known from DE 43 14 982 A1 to check, prior to administering the compressed air to the splicing chamber, the prerequisites for a successful splicing operation to determine whether the conditions required for a successful splicing process are present. If the successful splicing requirements are not met, the compressed air is not administered to the splicing chamber. Specifically, a determination is made whether one and/or both of the thread ends are present for splicing and/or whether the compressed air to be applied within the splicing chamber is sufficiently pressurized. Moreover, in connection with a so-called thermo-splicer the optimum temperature in the splicing chamber required for a quality splice is checked for.

As seen from the discussion of the prior art, the proper opening and closing of a splicing valve is not checked for, and furthermore, there is no testing of the splicing valve during the production run.

Nevertheless, the importance of a proper functioning splicing valve cannot be overemphasized with respect to the quality, strength, and appearance of a splicing produced thereby. Moreover, the proper functioning of the splicing valve is not solely dependent on whether the valve opens to apply the compressed air of a predetermined pressure to the splicing operation, but also on the duration of the opening and closing of the splicing valve which affects the pressure change per unit time, the rate of pressure change per unit time, and the duration and magnitude of the ultimately achieved in the splicing operation.

Malfunctions that occur in the correct opening and closing of the splicing valve often result from impurities carried by the compressed air, and in particular, moisture and oil of concentrations which tend to soil the splicing valve and inhibit proper operation thereof. Moreover, the soiling of a splicing valve is more detrimental than an inoperative splicing valve; the failure to perform a splice resulting from an inoperative splicing valve will be immediately noticed by an operator, whereas a soiled splicing valve that hesitantly opens, or opens only partially, will go unnoticed by an operator until further processing of the yarn in the weaving or knitting shop, where the yarn will experience an increase in the number of yarn breaks typically encountered thereby jeopardizing the quality of the entire yarn batch produced.

A need therefore exists for an improved testing method and device for yarn splicing devices wherein the splicing valve is tested to insure a successful quality yarn splice and, in particular, a need exists wherein the testing method is performed during the production run.

SUMMARY OF THE INVENTION

The novel method of the present invention is preferably practiced in conjunction with a yarn splicing device that includes a pneumatic splicing chamber, a compressed air line connecting the splicing chamber to a source of compressed air, an electromagnetic splicing valve disposed within the compressed air line and having two transitional positions (open and closed) for controlling delivery of the compressed air to the splicing chamber, and a control unit connected to the valve for initiating a transitional signal to the valve for opening and closing of the valve. The novel method includes, after initiating the transitional signal to the valve, the steps of determining a value representing a characteristic of the changing air pressure prevailing in the compressed air line resulting from a transition of the valve from one position to the other position, comparing the determined value and a reference value, and generating an error signal if the difference between the determined value and the reference value is greater than a predetermined variance value.

Preferably, the method of determining a value representing a characteristic of the changing air pressure comprises determining a characteristic of the increasing air pressure prevailing in the compressed air line between the valve and the splicing chamber that results from the compressed air being delivered to the splicing chamber after initiating an opening signal to open the valve. Moreover, the step of determining a characteristic of the increasing air pressure preferably includes the measuring of the value of the air pressure within the line and the method also preferably includes the further feature of delaying the measuring step by a predetermined length of time following the initiating of the opening signal to the valve so that the value of the air pressure measured represents an intermediate air pressure of the increasing air pressure within the line after initiation of the valve's opening.

In a feature of the present invention, the step of generating an error signal in the method of the present invention preferably includes generating an audible warning signal and generating an optical warning signal. Moreover, the novel method preferably includes the further step of stopping the splicing device when the error signal is generated.

In yet another feature of the present invention, the step of comparing the determined value and the reference value comprises the step of calculating the difference between the determined value and an operator-entered reference value. Alternatively, the step of comparing the determined value and the reference value comprises the steps of determining a corresponding value for the same characteristic of the changing air pressure prevailing in other compressed air lines of other splicing devices of the same type, calculating a reference value from the other determined corresponding values, and then calculating the difference between the determined value and the reference value calculated from the other corresponding determined values.

In a pneumatic splicing device having a splicing chamber, the device of the present invention for delivering compressed air to the splicing chamber comprises a compressed air line connecting the splicing chamber to a source of compressed air, an electromagnetic splicing valve disposed within the line having two transitional positions (opened and closed) for controlling delivery of compressed air to the splicing chamber, a control unit connected to the valve for initiating a transitional signal to the valve for delivery of compressed air to the splicing chamber, a sensor disposed within the line for determining a value representing a characteristic of the changing air pressure prevailing in the line resulting from a transition of the valve from one position to the other position, an evaluation device connected to the sensor for comparing a value determined by the sensor with a reference value, and an error signal generator for generating an error signal when the difference between the determined value and the reference value exceeds a predetermined variance value.

In the preferred embodiment, the sensor is a pressure sensor disposed within the compressed air line between the valve and the splicing chamber, and the determined value preferably represents a characteristic of the increasing air pressure prevailing in the line between the valve and the splicing chamber following the initiation of an opening signal and the opening of the valve. Moreover, the determined value is preferably a value corresponding to an intermediate air pressure occurring during the increasing air pressure in the line after initiating the opening signal. Furthermore, a delaying device is preferably provided in a further feature of the present invention for delaying the determination of the air pressure value by a predetermined length of time following initiating of the opening signal so that air pressure value measured within the line by the sensor represents an intermediate air pressure of the increasing air pressure occurring in the compressed air line after initiation of the opening signal.

Further features and advantages of the present invention ensue from the subsequent description of the preferred embodiment of the present invention shown in the drawings and discussed below.

BRIEF DESCRIPTION OF THE DRAWINGS

FIG. 2 includes a graph of voltage U(v) versus time (FIG. 2*a*) and a graph of pressure P versus time (FIG. 2*b*) for a splicing valve operating properly;

FIG. 3 includes a graph of voltage U(v) versus time (FIG. 3*a*) and a graph of pressure P versus time (FIG. 3*b*) for a soiled splicing valve that opens only partially; and FIG. 4 includes a graph of voltage U(v) versus time (FIG. 4*a*) and a graph of pressure P versus time (FIG. 4*b*) for a soiled splicing valve operating hesitantly.

DETAILED DESCRIPTION OF THE PREFERRED EMBODIMENT

Figure 1:
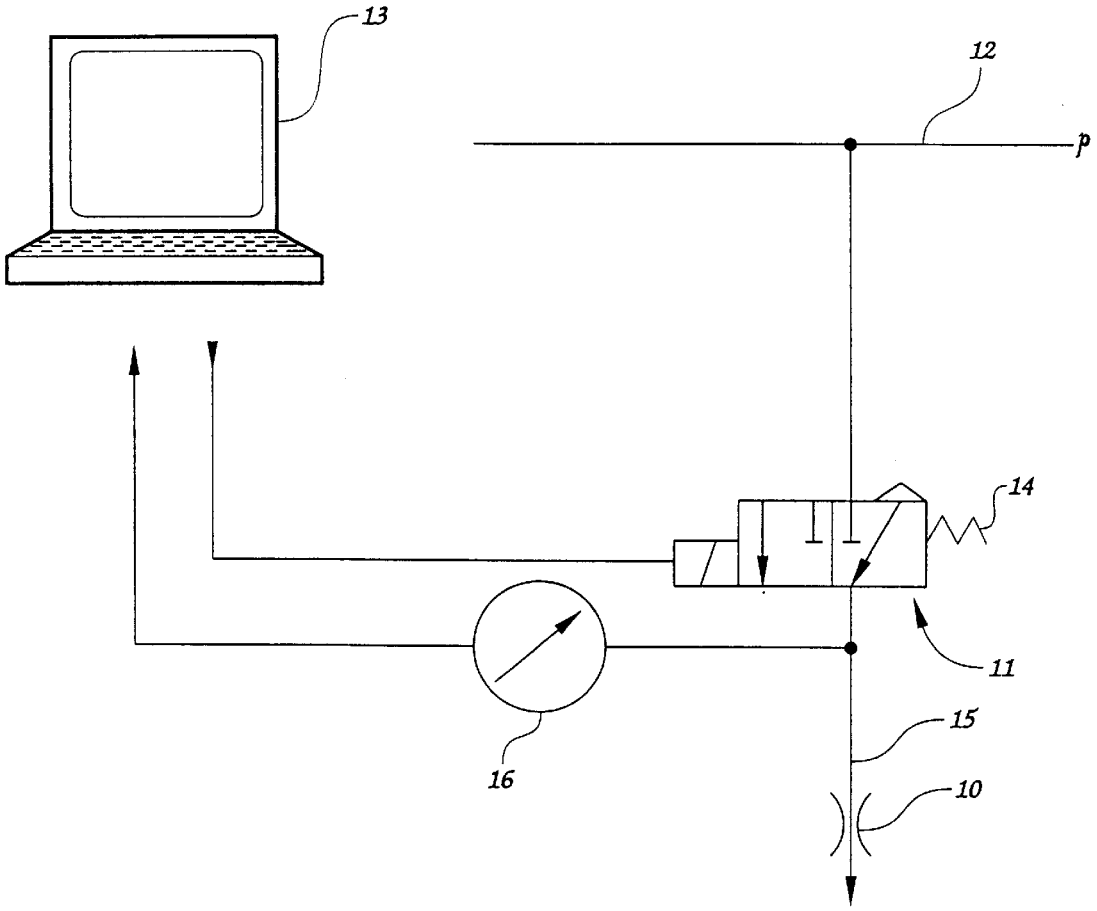
FIG. 1 is a schematic representation of a pneumatic yarn splicing device in accordance with the present invention.

Yarn splicing devices are typically used with automatic winding machines which make numerous yarn connections during the winding process. For instance, in the course of the winding process, yarn is pulled sequentially off different spinning bobbins and wound on a conical or cylindrical cheese. In the process the yarn is monitored for yarn faults during rewinding. Yarn faults are cut out, after which the yarn ends are connected with each other by means of a splicing device. Likewise, the start of a new spinning bobbin is also spliced with the end of the already wound yarn.

The pneumatic yarn splicing device of the present invention is preferably used in conjunction with an automatic winding machine, and only the elements of the pneumatic yarn splicing device which are essential for the present invention are schematically represented in FIG. 1. The conventional splicing device contains means (not shown) for picking up the yarn ends to be connected and for placing these yarn ends into a splicing chamber 10 which is schematically represented in FIG. 1. The yarn ends to be connected are usually prepared prior to being placed into the splicing chamber 10, wherein the yarn ends are opened and freed of excess fibers. Compressed air is applied in the splicing chamber 10 through compressed air line 15 for the splicing operation to intermix the the fibers of the yarn ends and to introduce a rotation into the spliced connection. The shape of the splicing chamber 10, as well as the number of compressed air nozzles in the splicing chamber 10, the length of the compressed air pulse (time during which the compressed air is applied in the splicing chamber 10), the magnitude of the air pressure applied, and the temperature of the compressed air all affect the quality of the splice, and values for each are preselected with regard to the yarn being wound in order to provide an optimum splice.

Specifically, the application of the compressed air to the splicing operation is controlled by an electromagnetic valve 11, which is preferably disposed in a compressed air line 15 that connects the splicing chamber 10 to a compressed air supply 12. The duration of applying the compressed air to the splicing operation 10 is regulated by a control unit 13 connected to the valve 11. The control unit 13 preferably comprises a winding station computer in which the optimum time for applying the compressed air is programmed. During the application of the compressed air, the control unit 13 preferably applies a voltage U(v) to the electromagnetic splicing valve 11 so that valve 11 makes a transition from the closed position to the open position and remains in the open position against the force of a return spring 14. When the voltage U(v) ceases, the return spring 14 returns the valve 11 to the closed position. In the preferred embodiment, the application of voltage U(v) to the electromagnetic splicing valve 11 is considered the opening signal, and the reduction in the voltage U(v) is considered the closing signal.

A sensor 16 is preferably connected to the compressed air line 15 between the splicing valve 11 and the splicing chamber 10. This pressure sensor 16 preferably measures the value of the air pressure in the line 15 following the opening of the splicing valve 11 and transmits a signal corresponding to the value of the air pressure measured in the line 15 to an evaluating unit that is preferably part of the control unit 13. The signal is then processed and compared by the evaluating unit as explained in greater detail below.

The pressure sensor 16 can measure and transmit signals either intermittently or continuously, as desired. However, only one measurement of the value of the air pressure within the line 15 at a predetermined time, and only one corresponding signal, are necessary in accordance with the present invention. Furthermore, in a feature of the present invention, the evaluating unit includes a time-measuring device for measuring a predetermined length of time following the initiating of the opening signal so that the specific prevailing pressure in the line can be measured by the pressure sensor 16 at a predetermined time during the air pressure increase in the line 15 between the valve 11 and the splicing chamber 10.

Once a signal is received by the evaluating unit, the corresponding measured value is compared with a corresponding reference value. When the difference between the measured value and the reference value exceeds a predetermined vairance value which is, for example, expressed in percent, the evaluating unit generates an error signal that preferably is an optical and audible warning signal and furthermore, the splicing device of the respective work station, like for example a winding station, is stopped when the error signal is generated. By utilizing audible and optical alarms, and by stopping the splicing process, the production of quality splices is maintained even in cases where an inattentive operator would otherwise fail to respond to an error signal.

In the evaluating and comparing process conducted by the evaluating unit, the signal of the pressure sensor 16, which preferably measures the value of the air pressure in the line 15, is compared with a predetermined, operator-entered reference value stored in the evaluating unit of the control unit 13. However, note that the air pressure increase per unit time in the line 15 is a function of the input pressure, i.e., the pressure in the compressed air source 12, and is a function of the shape of the splicing chamber 10 particularly depending upon the cross section and the number of the splicing nozzles in the splicing chamber 10. Therefore, if a changed splicing chamber 10 or a changed input pressure are utilized at a previously used winding station, as for example if another yarn is rewound, corresponding reference values must be entered into the evaluating unit in using this evaluation process.

In connection with another evaluation process, the measurement from the pressure sensor 16 is compared with a reference value which is obtained from previous measurements at adjoining winding stations whose splicing devices operate at the same input pressure and with the same type of splicing chamber 10. The reference value thereby calculated, such as the mean or average value, is primarily a function of the pressure of the supplied compressed air which is a variable dependent upon the type of yarn and/or the splicing chamber used in the splicing devices. The calculation of a reference value from measurements made for each splicing device therefore has the advantage that the calculated value more accurately reflects the proper reference value for the particular machine rather than a interpolated or calculated reference value based solely on a theoretical analysis of the desired pressure and the type of splicing chamber used. Moreover, no reentering of reference values is required following a change in the input pressure or the shape of the splicing chambers 10.

As will be apparent to one skilled in the art, the evaluating unit and the air pressure sensor 16 can also be utilized in accordance with the present invention to determine the air pressure in the line 15, the air pressure change per unit time in the line, and/or the rate of air pressure change per unit time in the line. Subsequently, any of these determined values, or the characteristics of the increasing air pressure prevailing in the line 15, can be compared with corresponding reference values derived from a similar valve operating under ideal circumstances to determine whether the splicing valve 11 is operating correctly. Moreover, as will also be apparent to one of ordinary skill in the art, the pressure sensor 16 could be placed in the line 15 between the compressed air source 12 and the valve 11 to measure the air pressure decrease in the line 15 following the initiation of the opening signal to the valve 11, and the measured value then compared to a corresponding reference value in accordance with the present invention. Likewise, the air pressure decrease in the line 15 between the valve 11 and the splicing chamber 10 following the initiation of a closing signal could also be measured and compared with a reference value in accordance with the present invention. In essence, any characteristic values of the air pressure change in the line 15 following a transition of the valve between the opening and closing positions can be measured and compared to a corresponding reference value in accordance with the present invention.

Thus, in sum, the pressure in the line 15 between the splicing valve 11 and the splicing chamber 10 is measured in the preferred method of the present invention after a predetermined period of time following the initiation of an opening signal that is sent to the splicing valve 11 that causes the splicing valve 11 to open from its closed position. The period of time is preferably short enough that the pressure is measured within the line during the air pressure increase therein, and not after a period of time whereat the desired air pressure of the compressed air to be applied to the splicing operation has been reached in a hesitantly operating splicing valve. By measuring the pressure within this period of time, it is possible to insure detection in a simple manner of whether the splicing valve 11 does not open completely and/or too slowly, since in such instances the pressure value measured in accordance with the present invention will necessarily be less than the reference value.

A simple example of the evaluation step of the preferred method of the present invention will now be explained with reference to FIGS. 2 through 4. In each respective Figure two graphs (a,b) are disposed one above the other to illustrate identical times being graphed. Each pair of graphs (a,b) shows the application of the voltage U(v) to the splicing valve 11 over the time t, and the associated pressure P, also over the time t, respectively. In FIGS. 2*a*, 3*a*, and 4*a* the moment of applying the voltage U(v) to the splicing valve 11 represents the initiating of the opening signal to the valve 11, and the end of the application of the voltage represents the initiating of the closing signal to the valve 11. After a predetermined length of time of, for example 20 ms, the air pressure value is measured by the pressure sensor 16 in the line 15 and is subsequently evaluated. As shown in FIG. 2*b*, after 20 ms the pressure achieved in the line 15 is the optimum, or source pressure $P_{so}$, when the splicing valve 11 is operating properly. This measured pressure of the properly operating valve is the reference value.

If the splicing valve 11 does not completely open, then the air pressure increases as shown shown in FIG. 3*b* but the optimum pressure $P_{so}$ is not achieved. Therefore, after the 20 ms, a pressure value is measured that differs by ΔP from the reference pressure achieved by the properly operating valve (which happens to be the optimum pressure in the example in FIG. 2*b*). When this pressure difference ΔP deviates by a predetermined percentage from the reference value $P_{so}$, then an optical and audible warning is generated to alert an operator, and the winding station having the respective splicing device is stopped.

If, on the other hand, the splicing valve 11 opens too slowly as shown in FIG. 4*b*, a delayed air pressure increase to the optimum pressure $P_{so}$ occurs in the line 15 which, after a measuring time of 20 ms, also leads to a difference ΔP' between the measured pressure and the reference pressure. Once again, when this pressure difference ΔP deviates by a predetermined percentage from the actual value $P_{so}$, an optical and audible warning is generated to alert an operator, and the winding station having the respective splicing device is stopped. Moreover, it should be noted that the predetermined length of time, i.e., 20 ms in the examples, should be short enough in duration to allow the proper measuring of the air pressure value during the air pressure increase of a hesitantly opening valve, else the optimum air pressure will be measured before the closing of the valve, there will be a ΔP' of zero, and the improper splice will defeat immediate detection. The length of time should therefore preferably be less than or equal to the time required for the air pressure in a line controlled by a properly operating valve to reach the optimum pressure, as a hesitantly operating valve will necessarily require a longer time to reach the optimum pressure.

A simple and inexpensive attainment of the objectives of the present invention thus results from the aforesaid monitoring in accordance with the present invention, which is performed during each splicing operation and each compressed air pulse, thus maintaining high quality yarn splices. Moreover, the present invention includes the additional benefit that not only the operation of the splicing valve is monitored, but also the air pressure in the compressed air source is indirectly monitored, since a failure in the pressure of the source of the compressed air necessarily will lead in the present invention to a greater difference between the measured value and the reference value.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a yarn splicing device including a pneumatic splicing chamber, a compressed air line connecting the splicing chamber to a source of compressed air, an electromagnetic splicing valve disposed within the compressed air line for controlling delivery of the compressed air to the splicing chamber, and a control unit connected to the valve for initiating an opening signal to the valve for opening of the valve, a method for testing the electromagnetic splicing valve comprising the steps of:

after the opening of the valve, determining a value representing a characteristic of the increasing air pressure prevailing in the compressed air line between the valve and the splicing chamber resulting from the compressed air being delivered to the splicing chamber through the valve, comparing the determined value and a reference value, and generating an error signal if the difference between the determined value and the reference value is greater than a predetermined variance value.

2. A method in accordance with claim 1, wherein said determining step comprises measuring the value of the air pressure within said line, and the method further comprises delaying said measuring step by a predetermined length of time following said initiating of the opening signal so that the pressure value measured within the line represents an intermediate pressure of the increasing air pressure occurring in the compressed air line after initiation of the opening signal.

3. The method in accordance with claim 1, wherein said step of comparing the determined value and the reference value comprises the step of calculating the difference between the determined value and operator-entered reference value.

4. The method in accordance with claim 1, wherein said step of comparing the determined value and the reference value comprises the step of:

determining a corresponding value for the same characteristic of the increasing air pressure prevailing in other compressed air lines of other splicing devices, calculating a reference value from the other corresponding determined values, and calculating the difference between the determined value and the reference value calculated from the other corresponding determined values.

5. The method in accordance with claim 1, wherein the step of generating the error signal comprises generating an audible warning signal.

6. The method in accordance with claim 1, wherein the step of generating the error signal comprises generating an optical warning signal.

7. The method in accordance with claim 1, further comprising the step of stopping the splicing device when the error signal is generated.

8. In a pneumatic splicing device having a splicing chamber, a device for delivering compressed air to the splicing chamber, comprising:

a compressed air line for connecting the splicing chamber to a compressed air source, an electromagnetic splicing valve disposed within said line having open and closed positions for controlling delivery of the compressed air to the splicing chamber, a control unit connected to said valve for initiating a transitional signal to said valve for opening and closing of said valve for controlled delivery of compressed air to the splicing chamber, a sensor disposed in said line for determining a value representing a characteristic of the changing air pressure prevailing in said line resulting from a transition of the valve from one position to the other position, an evaluating unit connected to said sensor for comparing a value determined by said sensor with a reference value, and an error signal generator that generates an error signal when the difference between the determined value and the reference value exceeds a predetermined variance value.

9. The device in accordance with claim 8, wherein said control unit comprises a computer and further includes said evaluating unit and said error signal generator.

10. The device in accordance with claim 8, wherein said sensor comprises a pressure sensor disposed in said line for determining a value representing a characteristic of the changing air pressure prevailing in said line.

11. The device in accordance with claim 10, wherein said pressure sensor is disposed in said line between said valve and the splicing chamber, and wherein said determined value represents a characteristic of the increasing air pressure prevailing in said line between said valve and the splicing chamber.

12. The device in accordance with claim 11, wherein said pressure sensor comprises means for measuring the value of the air pressure within said line.

13. The device in accordance with claim 12, further comprising means for delaying said measuring means by a predetermined length of time following initiation of the opening signal so that the air pressure value measured within said line by said sensor represents an intermediate air pressure of said increasing air pressure occurring in the compressed air line after initiation of the opening signal.

14. In a yarn splicing device including a pneumatic splicing chamber, a compressed air line connecting the splicing chamber to a source of compressed air, an electromagnetic splicing valve disposed within the compressed air line and having open and closed positions for controlling delivery of the compressed air to the splicing chamber, and a control unit for initiating a transitional signal to the valve for opening and closing of said valve, a method for testing the electromagnetic splicing valve comprising the steps of:

after initiating a transitional signal to the valve, determining a value representing a characteristic of the changing air pressure prevailing in the compressed air line resulting from a transition of the valve from one position to the other position, comparing the determined value and a reference value, and generating an error signal if the difference between the determined value and the reference value is greater than a predetermined variance value.

* * * * *